US006468188B1

(12) United States Patent
Koenig

(10) Patent No.: US 6,468,188 B1
(45) Date of Patent: Oct. 22, 2002

(54) EXERCISE APPARATUS FOR GLUTEUS AND HAMSTRING MUSCLES

(75) Inventor: Larry D. Koenig, Williamsburg, IA (US)

(73) Assignee: Jam'n Fitness Corp., Altus, OK (US)

( * ) Notice: Subject to any disclaimer, the term of this patent is extended or adjusted under 35 U.S.C. 154(b) by 0 days.

(21) Appl. No.: 09/538,789

(22) Filed: Mar. 30, 2000

(51) Int. Cl.[7] ..... A63B 21/08
(52) U.S. Cl. ..... 482/97; 482/72; 482/137
(58) Field of Search ..... 482/92–100, 104, 482/110, 114–116, 121, 126, 130, 131, 133, 136, 137–139, 907, 72

(56) References Cited

U.S. PATENT DOCUMENTS

| | | | | | |
|---|---|---|---|---|---|
| 4,336,934 | A | * | 6/1982 | Hanagan et al. | 272/72 |
| 4,765,613 | A | * | 8/1988 | Voris | 272/129 |
| 5,356,358 | A | * | 10/1994 | Chen | 482/96 |
| 5,637,063 | A | * | 6/1997 | Fuller, Sr. | 482/97 |
| 5,957,817 | A | * | 9/1999 | Koenig et al. | 482/72 |
| 6,113,524 | A | * | 9/2000 | Huang | 482/142 |
| 6,117,055 | A | * | 9/2000 | Boland | 482/121 |
| 6,179,757 | B1 | * | 1/2001 | Koenig | 482/97 |

OTHER PUBLICATIONS

Hammer Strength Rowing/Seated Shrug, Hammer: First in Strength, Hammer Strength brochure, p. 11, circa 1994.
Advertisement of Body Solid Fitness Factory Outlet, *Muscle and Fitness* Apr., 1996, p. 27.
Advertising brochure of Badger Magnum Strength Systems, 1010 Davis Avenue, South Milwaukee, WI 53172.
Advertising brochure: "Hammer Strength Product Information Guide, Feb., 1997", Hammer Strength, P. O. Box 19040, Cincinnati, OH 45219.
Advertising brochure: "Professional Series", Pro Industries, 1015 N. Hurricane Road, Franklin, IN 46131.

* cited by examiner

*Primary Examiner*—Justine R. Yu
(74) *Attorney, Agent, or Firm*—Allan L. Harms

(57) ABSTRACT

An exercise apparatus particularly designed to strengthen the gluteus and hamstring muscles is disclosed. A pivot arm includes a weight arm which can be loaded with weights as desired. The pivot arm pivots in a longitudinal direction at one side of the base of the apparatus. The pivot arm includes a paddled hip engagement bar which extends over the base. A handhold member is mounted to the base and is pivotable at a right angle to the pivot movement of the pivot arm. A latching on the pivot arm can engage a catch on the handhold member when the apparatus to be placed is in a parked position.

18 Claims, 4 Drawing Sheets

EXERCISE APPARATUS FOR GLUTEUS AND HAMSTRING MUSCLES

BACKGROUND OF THE INVENTION

In the field of strength training, exercise of the gluteus maximus and hamstring muscles is commonly carried out with lifting maneuvers involving the lifting of barbells, or with complicated machines requiring the user to climb onto apparatus to assume an awkward position. Injury can occur when improper weight lifting motions are performed which can also happen with poorly designed hip and gluteus muscle exercise apparatus.

SUMMARY OF THE INVENTION

The present invention provides an exercise machine which safely exercises the gluteus, hamstring, and spinal erector muscles while providing an opportunity for an intense workout of these muscle groups. The user may simply move into a standing position on the machine to begin the exercise.

A generally rectangular base frame to support the members of the machine has front and rear ends and opposing sides interconnecting the front and rear ends. An upright handhold member is pivotally mounted to the base frame generally at its center.

The handhold member is pivotable from side to side on the frame over only a limited range from a park position to an operating position of the machine. On the upper end of the handhold member there is a cross bar on which two upright hand grips are mounted such that the axes of the hand grips are substantially parallel to the axis of the upright handhold.

The upright handhold member includes an elongate bar pivotally mounted to the front end of the base frame and a stabilizer member extending rearward from the elongate bar. The stabilizer member is fixed to the elongate bar along its length near the lower end of the elongate bar. The stabilizer member includes a first generally horizontal bar which extends rearwardly from the elongate bar. Fixed to the horizontal bar at its rear end is a generally vertical leg which at its lower end is pivotally mounted to a medial cross member of the base frame which interconnects the sides of the base frame generally midway between the front and rear ends of the base frame. The stabilizer is also equipped with a transverse horizontal bar which extends perpendicularly from the first horizontal bar of the stabilizer toward the left side of the base frame. A brace further strengthens the stabilizer by crossing between the transverse horizontal bar of the stabilizer and the first horizontal bar thereof. Because the vertical leg of the stabilizer member pivots in the same plane as the elongate upright member, the entire handhold member pivots on the base frame over a limited range from generally vertical to slightly inclined.

Along the left side of the base frame there is mounted a variable length post which is pivotally mounted at its lower end to the left side of the base frame. The pivoting movement of the variable length post is within a vertical plane defined by the left side of the base frame. The variable length post is generally vertical when the machine is in the park position. The variable length post includes a lower tube and an upper tube which is slidable within the lower tube to adjust the length of the variable length post. A lock pin mechanism fixes the extension of the upper tube from the lower tube at the desired position.

Extending rearward from the lower tube of the variable length post is a weight support arm which is fixed to the lower tube near the top thereof. The angle of the axis of the weight support arm is slightly greater than ninety degrees relative to the axis of the lower tube of the variable length post.

Near the free end of the rearwardly extending weight support arm is a perpendicular weight support rod which extends horizontally from the weight support arm. This weight support rod can receive circular Olympic-style free weights.

Mounted to the upper end of the upper tube of the variable length post is a padded body engagement bar which extends from the variable length post generally horizontally over the base frame. This padded body engagement bar is engaged by the hip region of the user, the length of the variable length post being adjustable to properly engage users of differing heights.

A foot plate is mounted between the sides of the base frame extending rearward and downward from the medial cross member of the base frame. By inclining the foot plate on which the user stands, proper posture for the user can be achieved while exercise is being accomplished.

The machine is held in the park position by latching the upright handhold member to the variable length post. This is accomplished through use of a bracket arm which extends rearwardly from the second horizontal bar of the stabilizer member. This bracket arm projects slightly downward such that the curve of the bracket arm follows the arc of movement of a fixed point on the variable length post as the variable length post pivots about its mounting. The variable length post includes a catch which may be engaged by at least one complementary hook on the bracket member. In order for the catch on the variable length post to engage a hook on the bracket member, the handhold upright member must be pivoted slightly toward the left side of the base frame and once a hook on the bracket member engages the catch on the variable length member, the machine is locked in its park position. In that position the variable length member is generally upright and the handhold upright member is tilted slightly toward the left side of the base frame. Of course it is to be understood that the machine could be built as a mirror image of that described immediately above and that many variations could be made without departing from the structural functionality of the exercise machine.

It is an object of the invention to provide an exercise machine which effectively exercises the gluteus, hamstring, and spinal erector muscles.

It is also an object of the invention to provide an exercise machine which permits the user to exercise with little risk of injury.

It is a further objection of the invention to provide a machine which can be selectively loaded with ordinary Olympic-style free weights.

It is also an object of the invention to provide a machine which allows the user to exercise the gluteus and hamstring muscles from a standing position.

These and other objects of the invention will become apparent from examination of the description and claims which follow.

DESCRIPTION OF THE DRAWING FIGURES

DETAILED DESCRIPTION OF THE INVENTION

Figure 1:
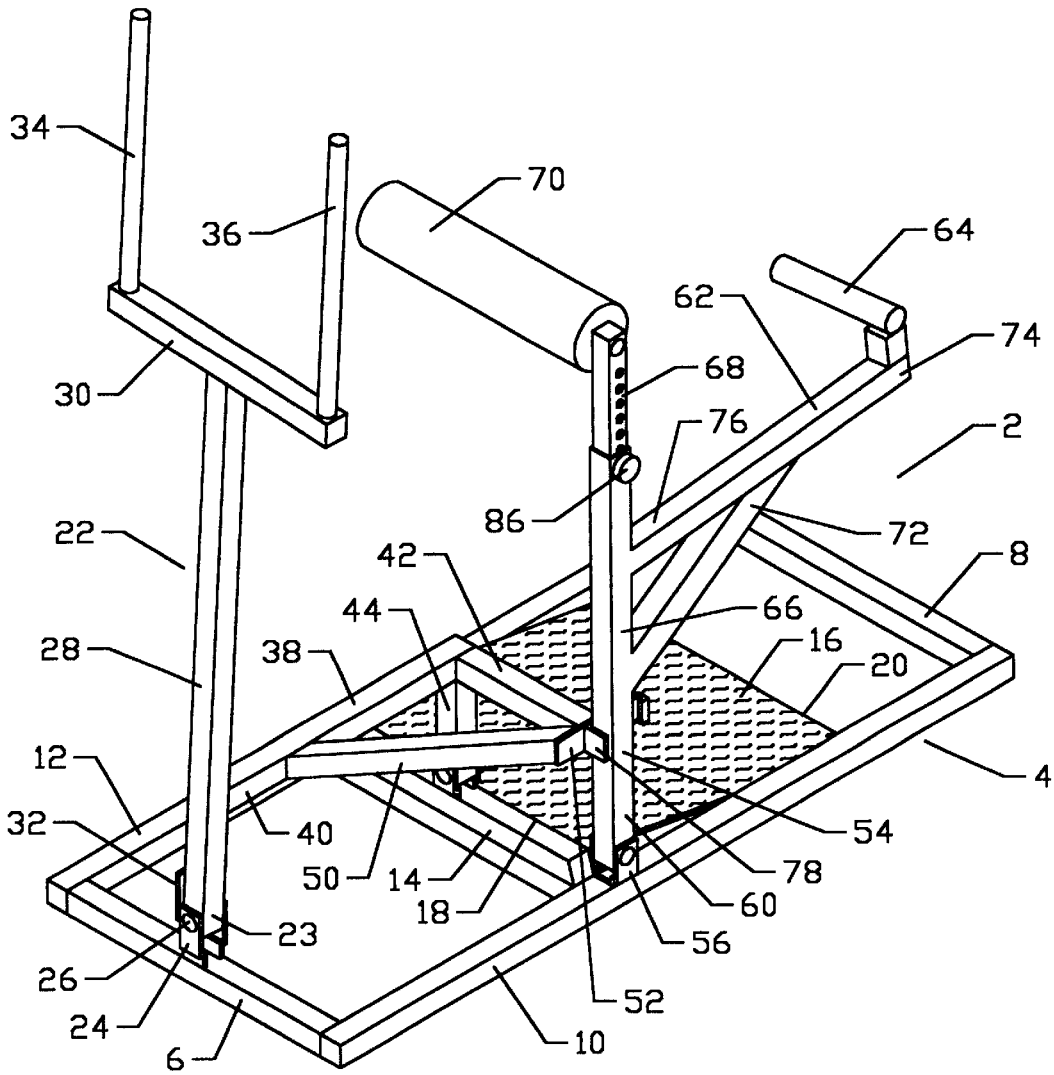
FIG. 1 is a front right perspective of the invention exercise apparatus shown in its parked position with its pivot post locked in an upright position.
Figure 2:
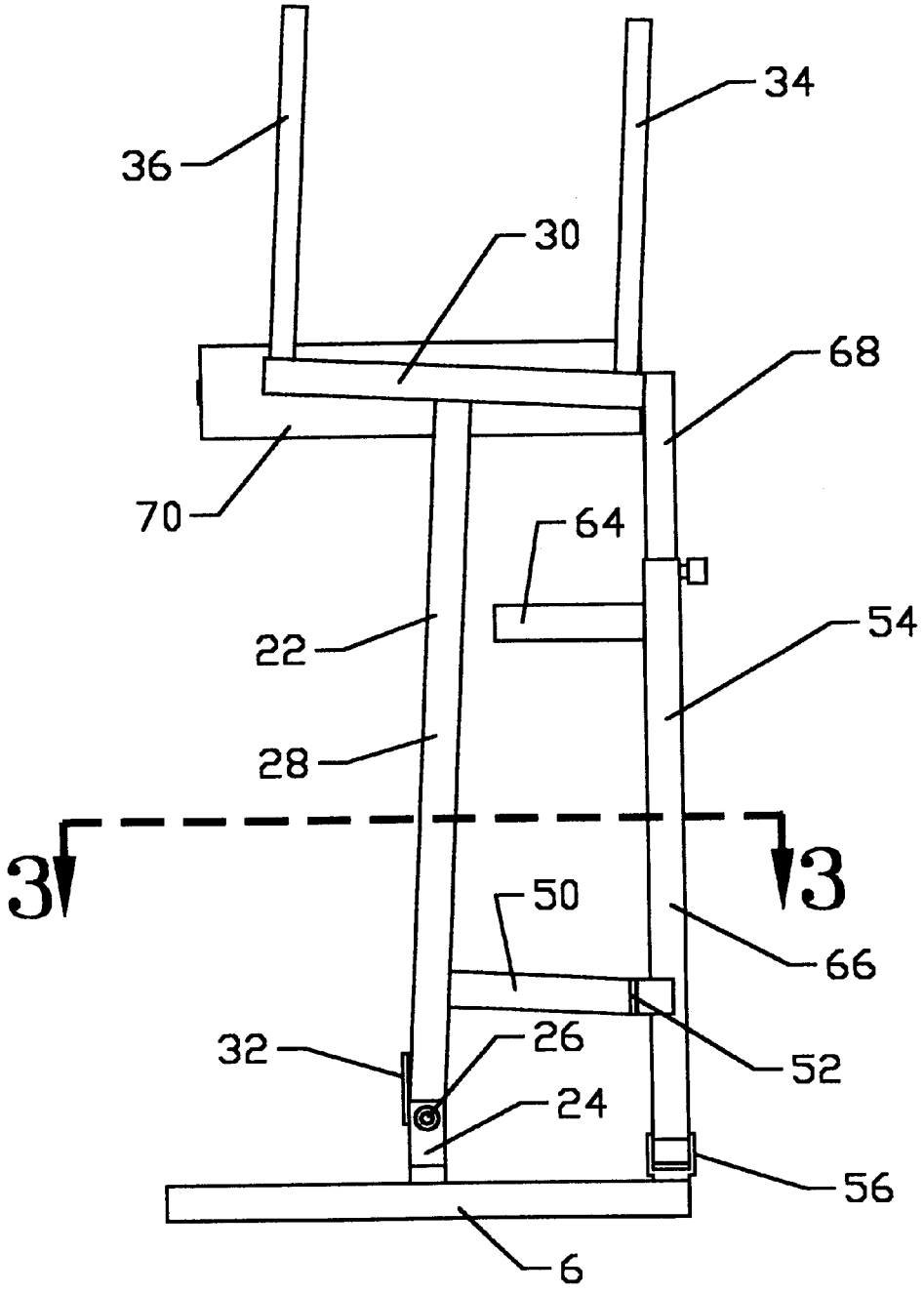
FIG. 2 is a front end plan view of the invention shown in its parked position with the handhold member tilted toward the pivot post of the device.
Figure 3:
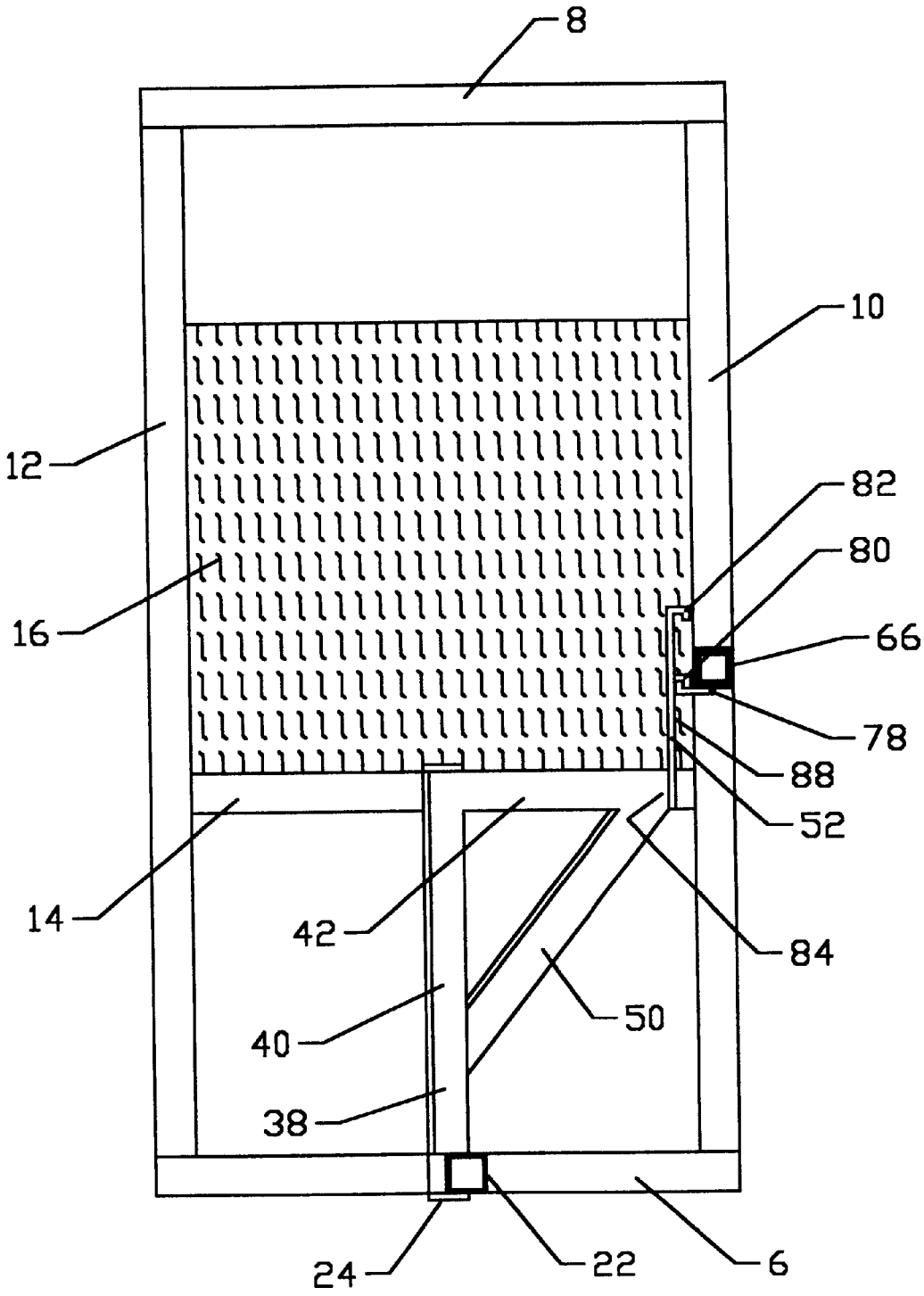
FIG. 3 is an overhead cross section view taken along line 3—3 of FIG. 2.

Referring to FIGS. 1–3, the preferred embodiment of exercise apparatus 2 is shown in its parked position. Exercise apparatus comprises a base 4 which is preferably rectangular, having a front end 6, an opposing rear end 8 and opposing sides 10 and 12 which interconnect the front end 6 and the rear end 8. Generally midway along base 4 is a medial cross member 14 which joins the sides 10, 12 at right angles. A foot plate 16 is mounted within base 4 between medial cross member 14 and rear end 8. Foot plate 16 is inclined such that its front edge 18 is supported upon medial cross member 14 and is higher than its rear edge 20 which is supported between sides 10, 12.

Mounted generally centrally along front end 6 is upstanding handhold member 22 which is pivotally retained to front end 6 at its lower end 23. Lower end 23 is mounted in pivot bracket 24 by axle 26. A stop plate 32 extends vertically from one side of pivot bracket 24 to prevent rotation of handhold member 22 past vertical in one direction of its pivot. Stop plate 32 also limits the rotation of handhold member 22 in the reverse direction to preferably less than about ten degrees from vertical.

Handhold member 22 comprises an elongate bar 28 at the top of which is mounted a cross bar 30 which is generally perpendicular to, and centered upon elongate bar 28. Mounted spaced apart to the cross member 30 at its opposing ends are handgrips 34 and 36 which are generally identical and extend vertically. Handgrips 34 and 36 may be padded (not shown) for comfort when they are grasped by the user.

Extending rearward from elongate bar 28 is a stabilizer member 38 which is pivotally mounted to medial cross member 14. Stabilizer member 38 assists in preventing handhold member 22 from deflecting rearward when the exercise apparatus 2 is operated. Stabilizer member 38 comprises a first horizontal bar 40 extending rearward longitudinally which is joined to a vertical leg 44 which is pivotal on medial cross member 14. The axis of pivot of vertical leg 44 is the same as the axis of pivot pin 26. Joined perpendicularly at the connection of first horizontal bar 40 to vertical leg 44 is a transverse bar 42 which extends toward left side 10 of base 4. A brace 50 interconnects first horizontal bar 40 to transverse bar 42. A bracket arm 52 extends rearward from free end 84 of transverse bar 42 and is provided with forward bracket 80 and rear bracket 82 on its outer face 88.

Mounted along left side 10 of base 4 is pivot arm 54 which is pivotal about its lower end 60 which is retained to left side 10 by pivot arm bracket 56. A pivot axle 58 oriented transversely to the axis of left side 10 provides an axis of pivot of pivot arm 54 such that pivot arm 54 will pivot in the vertical plane defined by left side 10. Pivot arm bracket 56 retains pivot arm 54 generally adjacent the forward edge 18 of foot plate 16.

Pivot arm 54 comprises an upper tube 68 which is axially slidable within lower tube 66. The extension of upper tube 68 is selected by use of spring loaded pin 86 in the well known manner.

Mounted along upper tube 68 preferably at its upper end is engagement bar 70 which extends over base 4, generally horizontally. Engagement bar 70 is preferably padded because it will be contacted by the front of the hip area of the user. The location of pivot arm 54 on base 4 is selected to space engagement bar 70 sufficiently from hand grips 34, 36 such that a user may lean forward to grasp handgrips 34, 36.

Pivot arm 54 further comprises a weight arm 62 which extends rearward from the upper end of lower tube 66. Weight arm 62 defines an acute angle with upper tube 68 of pivot arm 54, the angle being preferably in the range of seventy-five to eighty-nine degrees, most preferably about eighty-five degrees. A gusset bar 72 supports weight arm 62. Weight arm 62 comprises a free end 74 adjacent to which is perpendicularly mounted a weight suspension rod 64. Other structures for suspending free weights on weight arm 62 are also feasible, including hooks, vertical posts, etc. Preferably weight suspension rod 64 extends horizontally over base 4 to keep exercise apparatus 2 compact and to avoid any structural members extending from the perimeter of base 4.

Weight arm 62 is sufficiently long to locate weight suspension rod 64 substantially rearward from the fulcrum provided by pivot axle 58, such that pivot arm 54 would not easily rotate forward of a vertical position. A stop may be provided at pivot arm bracket 56 to prevent rotation of pivot arm 54 forward of a vertical position when operated.

Reference is now directed to FIG. 3. It can be seen that lower tube 66 of pivot arm 54 is a hollow box tube having a latch 78 extending over foot plate 16 a short distance.

Details of the latching mechanism of the preferred embodiment are best visualized in FIG. 3. Forward bracket 80 of bracket arm 52 is abutted to latch 78 to prevent the pivot arm 54 from rotating rearward. A second rear bracket 82 is provided along bracket arm 52 to provide an alternative latch point which allows the exercise apparatus 2 to be parked in an alternative position, for instance if the user experiences fatigue and cannot return pivot arm 54 to vertical to latch it to forward bracket 80. It is to be understood that forward bracket 80 and rear bracket 82 of bracket arm 52 may only become engaged with latch 78 when handhold member 22 is tilted, a few degrees, toward the side on which the pivot arm 54 is mounted, as is easily understood from examination of FIG. 2.

Figure 4:
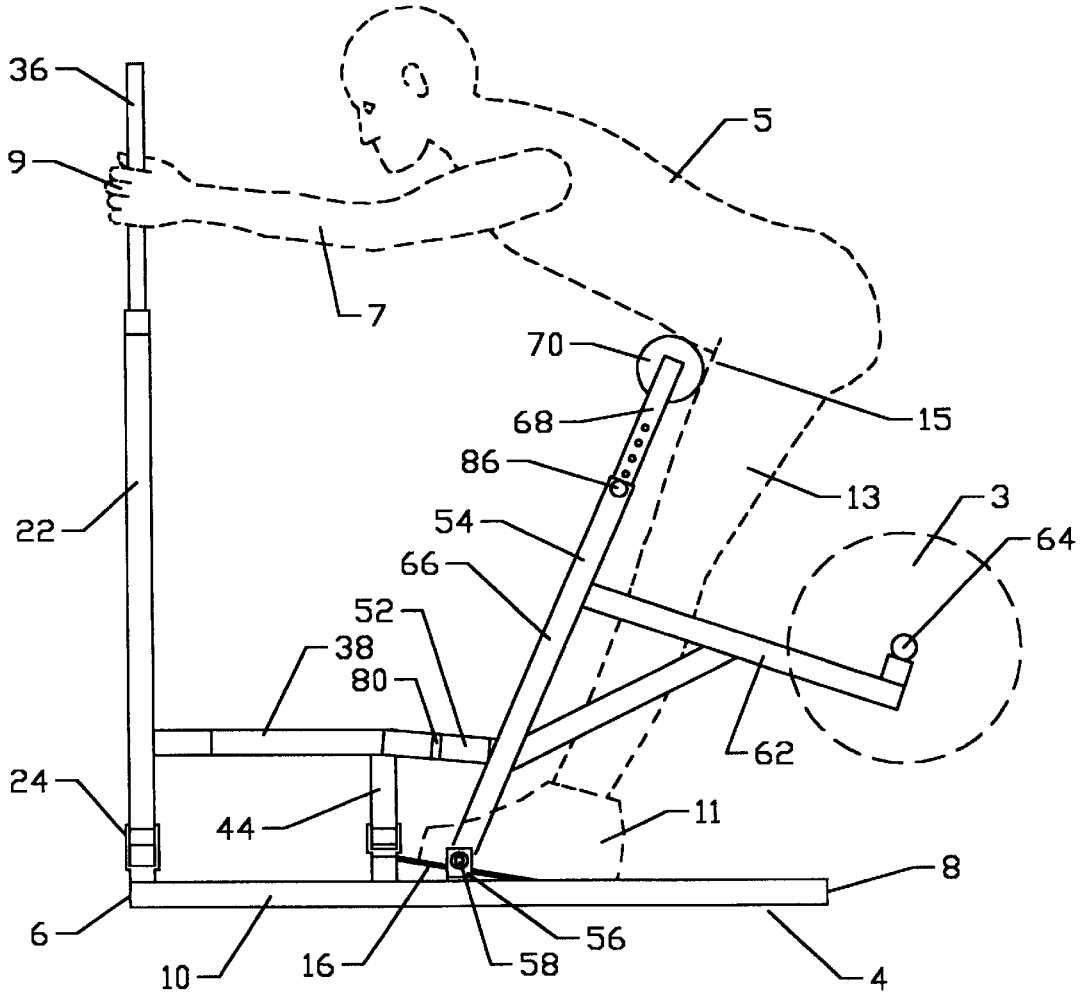
FIG. 4 is a left side plan view of the invention shown in operation by a user shown in dashed lines.

Referring now to FIG. 4, the exercise apparatus 2 is shown in operation by user 5. User 5 stands with user's feet 11 upon foot plate 16. User 5 leans forward to extend user's arms 7 so that handgrips 34, 36 may be grasped by the user's hands 9. User's legs 13 remain generally straight and user 5 engages engagement bar 70 at user's hip region 15. A circular weight plate 3 of desired mass has been mounted on weight rod 64 before user 5 has released pivot arm 52 to begin exercise. The user 5 must force engagement bar 70 forward and then rotate handhold member 22 from its tilted position to a substantial vertical. This allows latch 78 to disengage front bracket 80 and allows pivot arm 54 to rotate rearward from the moment of weight 3. By extending user's gluteus and hamstring muscles, user 5 allows pivot arm 54 to rotate toward rear end 8 to the extent of user's reach. Thereafter, user 5 contracts his gluteus and hamstring muscles thrusting the hips forward to force pivot arm 54 to return to an upright position. After repetition of the exercise is complete, user 5 may force engagement bar 70 forward sufficiently while tilting handhold member 22 to the left to allow latch 78 to slide along face 88 of bracket arm 52 until it engages and is caught by either forward bracket 80 or rear bracket 82. As can be seen in FIG. 4, bracket arm 52 is angled downward such that the latch 78 on pivot arm 54 will generally follow the contour of bracket arm 52. Preferably bracket arm 52 is curved to replicate the arc defined by the latch 78 as pivot arm 54 is pivoted about pivot axle 58.

An intense workout of the hamstring and gluteus muscles is possible without risk of injury to the spine due to the stabilized position of the user 5 with user's hands secured to handgrips 34, 36.

Many variations will be apparent to those skilled in the art. It is therefore to be understood, that within the scope of the appended claims, the invention may be practiced other than as specifically described.

Having described the invention, I claim:

1. Exercise apparatus comprising a base frame having a front, an opposing rear, and opposing sides interconnecting the front and the rear, a handle member pivotally mounted to said base frame for a user to grasp when using the exercise apparatus, the handle member comprising a primary elongate member having a lower end and an upper end, the lower end pivotally mounted to said front of said base frame for limited pivotal movement thereon, said handle member extending upward from said front of said base frame and pivotal from an upright position to a second position inclined toward a first of said opposing sides, an elongate post pivotally mounted to the first of said opposing sides, the post having an upper free end, said elongate post pivotal from a generally upright position to a rearwardly extending position, said elongate post having a substantially horizontal body engagement bar extending therefrom near said upper free end thereof, said elongate post having a rearwardly extending weight support arm fixed thereto, said weight support arm receiving weights selectively mounted thereto.

2. The exercise apparatus of claim 1 wherein, said handle member is provided with a pair of spaced apart hand grips thereon.

3. The exercise apparatus of claim 1 wherein, said elongate post has a bracket thereon, said handle member has a rearwardly extending bracket arm thereon, said bracket arm having at least one latch thereon, said at least one latch selectively engages said bracket on said elongate post when said handle member is inclined toward said first of said opposing sides.

4. The exercise apparatus of claim 1 wherein said elongate post is selectively variable in length.

5. The exercise apparatus of claim 1 wherein, said primary elongate member has a transverse member at said upper end thereof, said transverse member having a pair of axially upright hand grips mounted thereto.

6. The exercise apparatus of claim 1 wherein, said primary elongate member has a rear side thereon, said handle member comprises a stabilizer mounted to the rear side of said primary elongate member, said stabilizer pivotally mounted to said base frame, said stabilizer having a rearwardly extending bracket arm thereon, said bracket arm having a latch thereon, said elongate post having a bracket thereon, said latch engages said bracket of said elongate post when said handle member is inclined toward said first of said opposing sides.

7. The exercise apparatus of claim 1 wherein, said base frame has an inclined foot plate mounted thereon, said foot plate mounted upon said base frame medially therealong, said foot plate having a front edge and a rear edge, said front edge disposed forward of said mounting of said elongate post, said front edge of said foot plate higher than said rear edge thereof.

8. Exercise apparatus to strengthen the gluteus and hamstring muscles of a user comprising, a base having a forward end and a rearward end and having a foot plate mounted thereon, an elongate post pivotally mounted to said base adjacent said foot plate, said elongate post pivotal within a generally vertical plane, said elongate post having an elongate weight arm disposed rearwardly therefrom for receiving free weights thereon, said elongate post having a transverse bar mounted thereto, said transverse bar being generally horizontal and extending over said foot plate, an upright member mounted to said base having at least one handgrip thereon, said upright member spaced apart horizontally from said transverse bar, whereby the user may stand on said foot plate with said transverse bar touching said user's hip region and reach over said transverse bar to grasp said at least one handgrip of said upright member and then flex at the waist to allow said elongate post to rotate toward said rearward end of said base and then straighten at the waist to cause said elongate post to rotate toward said forward end of said base.

9. The exercise apparatus of claim 8 wherein said elongate post is longitudinally extendable.

10. The exercise apparatus of claim 8 wherein, said foot plate has a forward edge and an opposing rearward edge, said forward edge of said foot plate disposed toward said forward end of said base, said foot plate is inclined with the forward edge thereof disposed higher than the rearward edge thereof.

11. The exercise apparatus of claim 10 wherein, said elongate post is pivotally mounted to said base slightly rearward of said forward edge of said foot plate.

12. The exercise apparatus of claim 8 wherein, said base is substantially rectangular with opposing sides interconnecting said forward end and said rearward end thereof, said elongate post mounted to one of said opposing sides and pivotal in alignment therewith, said upright member is pivotally mounted to said forward end and pivotal in alignment therewith, said upright member pivotal from vertical to an inclined position directed toward said one of said opposing sides to which said elongate post is mounted.

13. The exercise apparatus of claim 12 wherein, said upright member has a bracket arm extending toward said rearward end of said base, said bracket arm having at least one bracket thereon, said elongate post has at least one latch thereon, said at least one bracket of said bracket arm selectively interlocked with said at least one latch of said elongate post when said upright member is tilted toward said elongate post.

14. The exercise apparatus of claim 8 wherein said upright member is pivotally mounted to said base and is pivotable in a plane substantially perpendicular to said plane of pivot of said elongate post.

15. The exercise apparatus of claim 8 wherein said elongate post is longitudinally extendable, said foot plate has a forward edge and an opposing rearward edge, said forward edge of said foot plate disposed toward said forward end of said base, said foot plate is inclined with the forward edge thereof disposed higher than the rearward edge thereof, said elongate post is pivotally mounted to said base slightly rearward of said forward edge of said foot plate, said base is substantially rectangular with opposing sides interconnecting said forward end and said rearward end thereof, said elongate post mounted to one of said opposing sides and pivotal in alignment therewith, said upright member is pivotally mounted to said forward end and pivotal in alignment therewith, said upright member pivotal from vertical to an inclined position directed toward said one of said opposing sides to which said elongate post is mounted, said upright member has a bracket arm extending toward said rearward end of said base, said bracket arm having at least one bracket thereon, said elongate post has at least one latch thereon, said at least one bracket of said bracket arm selectively interlocked with said at least one latch of said elongate post when said upright member is tilted toward said elongate post.

16. An exercise apparatus for exercising the gluteus and hamstring muscles of a standing user comprising, a base having a first elongate member pivotally mounted thereto, the base having a foot plate mounted thereon, said first elongate member pivotal within a first vertical plane, said base having a second elongate member pivotally mounted thereto, said second elongate member pivotal in a second vertical plane substantially perpendicular to said first vertical plane, said first elongate member comprising a weight arm fixed thereto to receive free weights suspended thereon, said weight arm biasing said first elongate member to pivot away from said second elongate member, said first elongate member comprising a horizontally disposed bar extending therefrom over said foot plate disposed on said base, means for the user to grip said second elongate member when said user stands upon said foot plate whereby said user is urged by said bar toward a position wherein said user flexes at said user's waist.

17. An exercise apparatus for exercising the gluteus and hamstring muscles of a standing user comprising, a base having a first elongate member pivotally mounted thereto, said first elongate member pivotal within a first vertical plane, said base having a second elongate member upstanding thereon, said first elongate member comprising a weight arm fixed thereto, said weight arm biasing said first elongate member to pivot away from said second elongate member, said first elongate member comprising an elongate bar extending generally horizontally therefrom, said elongate bar generally perpendicular to said first vertical plane, said second elongate member spaced apart from said elongate bar, whereby said user may grip said second elongate member while said user is urged by said elongate bar toward a position wherein said user flexes at said user's waist.

18. The exercise apparatus of claim 17 wherein said second elongate member is pivotable upon said base, said second elongate member is pivotable within a second vertical plane generally perpendicular to said first vertical plane.

* * * * *